US007892482B2

(12) United States Patent
Bischofberger et al.

(10) Patent No.: US 7,892,482 B2
(45) Date of Patent: Feb. 22, 2011

(54) MATERIAL ON THE BASIS OF AN ALUMINUM ALLOY, METHOD FOR ITS PRODUCTION, AS WELL AS USE THEREFOR

(75) Inventors: Ulrich Bischofberger, Esslingen (DE); Peter Krug, Velbert (DE); Gero Sinha, Velbert (DE)

(73) Assignees: Mahle GmbH, Stuttgart (DE); Peak Werkstoff GmbH, Velbert (DE)

( * ) Notice: Subject to any disclaimer, the term of this patent is extended or adjusted under 35 U.S.C. 154(b) by 194 days.

(21) Appl. No.: 10/589,215

(22) PCT Filed: Feb. 15, 2005

(86) PCT No.: PCT/DE2005/000254

§ 371 (c)(1),
(2), (4) Date: Sep. 7, 2006

(87) PCT Pub. No.: WO2005/078147

PCT Pub. Date: Aug. 25, 2005

(65) Prior Publication Data

US 2007/0169861 A1 Jul. 26, 2007

(30) Foreign Application Priority Data

Feb. 16, 2004 (DE) ..... 10 2004 007 704

(51) Int. Cl.

| | |
|---|---|
| ***C22C 21/08*** | (2006.01) |
| ***C22C 21/04*** | (2006.01) |
| ***C22C 21/14*** | (2006.01) |
| ***C22C 21/02*** | (2006.01) |
| ***C22C 21/06*** | (2006.01) |
| ***C22F 1/04*** | (2006.01) |

(52) U.S. Cl. ..... 420/534; 420/537; 420/546; 420/548; 148/439; 148/552; 148/690; 148/694; 148/700

(58) Field of Classification Search ..... 148/552, 148/690, 694, 700, 439; 420/534, 537, 546, 420/548

See application file for complete search history.

(56) References Cited

U.S. PATENT DOCUMENTS

| | | | | |
|---|---|---|---|---|
| 4,917,739 | A * | 4/1990 | Adam et al. | 148/437 |
| 5,178,686 | A * | 1/1993 | Schmid et al. | 148/439 |
| 5,520,754 | A | 5/1996 | Yaney et al. | |
| 6,419,769 | B1 | 7/2002 | Lee et al. | |
| 6,531,089 | B1 | 3/2003 | Brungs et al. | |

FOREIGN PATENT DOCUMENTS

| | | | |
|---|---|---|---|
| DE | 747 355 | C | 9/1944 |
| DE | 14 83 229 | B1 | 12/1973 |
| DE | 38 42 812 | A1 | 6/1990 |
| EP | 0 375 025 | A | 6/1990 |
| EP | 10 12 353 | B1 | 11/2002 |
| FR | 2 690 957 | A1 | 11/1993 |
| JP | 50-008693 | | 4/1975 |
| JP | 02-221349 | | 9/1990 |

OTHER PUBLICATIONS

Joseph R. Davis, ASM Handbook—Spray Forming, 1998, ASM International, 9th Edition, vol. 7, 396-397.*
Joseph R. Davis, ASM Handbook—Nonferrous Continuous Casting, 1988, ASM International, 9th Edition, vol. 15, 313-314.*
Joseph R. Davis, ASM Handbook—Forging of Aluminum Alloys, 1988, ASM International, 9th Edition, vol. 14, 241-244.*
Arai et al., ASM Handbook—Heat Treating of Aluminum Alloys—Strengthening by Heat Treatment, 1991, ASM International, vol. 4, p. 1-3.*
Kaufman, J.G., Aluminum Alloy Castings, 2004, ASM International, p. 15.*
Ogris, E., et al., "Entwicklung eines neuen Wärmebehandlungsverfahrens . . . ", Druckguss-Praxis, 2002 pp. 23-27.
Lima, E.B.F., et al.,"Dependence of the Microstructure . . . ", Institute for Materials Science and Technology, 2003, Germany, pp. 908-915.
E.R. Mishima et al.: "Superplasticity of strip cast aluminum alloys", Metasls Abstracts, Band 19, Nr. 2, Feb. 1986; Nr. 31-0581. (Abstract).
E.R. Mishima et al.: "Superplasticity of strip cast aluminum alloys", Metasls Abstracts, Band 19, Nr. 2, Feb. 1986; Zusammenfassung Nr. 31-0581.
Ogris, E., et al., "Entwicklung eines neuen Wärmebehandlungsverfahrens . . . ", Druckguss-Praxis, 2002 pp. 23-27 (English Translation).

* cited by examiner

*Primary Examiner*—Roy King
*Assistant Examiner*—Caitlin Fogarty
(74) *Attorney, Agent, or Firm*—Collard & Roe, P.C.

(57) ABSTRACT

The invention concerns a method for producing a substance during which an aluminum base alloy is produced that has a content of 5.5 to 13.0% by mass of silicon and a content of magnesium according to formula Mg [% by mass]=1.73×Si [% by mass]+m with m=1.5 to 6.0% by mass of magnesium, and has a copper content ranging from 1.0 to 4.0% by mass. The base alloy is then subjected to at least one hot working and, afterwards, to a heat treatment consisting of solution annealing, quenching and artificial aging. The magnesium is added based on the respectively desired silicon content according to the aforementioned formula. The material obtained by using the inventive method comprises having a low density and a high strength.

16 Claims, No Drawings

MATERIAL ON THE BASIS OF AN ALUMINUM ALLOY, METHOD FOR ITS PRODUCTION, AS WELL AS USE THEREFOR

CROSS REFERENCE TO RELATED APPLICATIONS

Applicant claims priority under 35 U.S.C. §119 of German Application No. 10 2004 007 704.5 filed Feb. 16, 2004. Applicant also claims priority under 35 U.S.C. §365 of PCT/DE2005/000254 filed Feb. 15, 2005. The international application under PCT article 21(2) was not published in English.

The present invention relates to a method for the production of a material on the basis of an aluminum alloy, in accordance with the preamble of claim 1, a material that can be obtained with this method, as well as to a use of this material.

In recent years, an increasing trend towards even lighter and more compact units with increased specific performance has been observed in connection with internal combustion engines for motor vehicles. This also causes, among other things, constantly increasing stress of the pistons used for this purpose. This trend can be taken into account not only by means of changed designs, but also and in particular by means of the development of new suitable materials. In this connection, the desire for highly heat-resistant and specifically light materials stands in the foreground.

Up to now, pistons have usually been produced from aluminum-silicon cast alloys. Because of their good casting properties, pistons on the basis of aluminum-silicon alloys can be produced relatively cost-advantageously and simply, using the chill-casting method.

These materials are typically alloyed with silicon contents between 12 and 18 wt.-%, in individual cases also up to 24 wt.-%, as well as with admixtures of magnesium between 1 to 1.5 wt.-%, copper between 1 and 3 wt.-%, and frequently also nickel between 1 to 3 wt.-%. In order to improve the heat-resistance of such an alloy, it is recommended according to U.S. Pat. No. 6,419,769 A1, for example, to adjust the copper content between 5.6 and 8.0 wt.-%. According to FR 2 690 957 A1, the strength of such an alloy is additionally increased by adding the elements titanium, zirconium, and vanadium. However, the density of the material is increased by alloying in these strength-increasing elements.

A heat-resistant alloy having a reduced specific weight is described in the patent document DE 747 355 as being particularly advantageous for pistons. This material is characterized by a magnesium content between 4 and 12 wt.-% and a silicon content between 0.5 and 5 wt.-%, whereby the silicon content is always supposed to be less than half the magnesium content. Furthermore, between 0.2 and 5 wt.-% copper and/or nickel are alloyed in. This material is also supposed to be characterized by improved heat resistance, while doing without additional strength-increasing components that are alloyed in.

In DE 38 42 812 A1, a light casting material on the basis of an aluminum alloy having 5 to 25 mass-% magnesium silicide is described. Aside from magnesium silicide, an excess of both silicon (up to 12 mass-%) and of magnesium (up to 15 mass-%) is considered to be advantageous. Furthermore, up to 5 mass-% copper, nickel, manganese, and cobalt can be alloyed in. In dependent claim 5, the liquidus temperature of <700° C. in the three-substance system Al—Si—Mg is additionally named as a limiting limit. Advantages and disadvantages in connection with the mechanical properties, which could result from an excess of magnesium or of silicon, respectively, are not explicitly mentioned.

These known materials are, without exception, casting materials. However, there is also a need for materials having even lower density and even higher strength, which it has not been possible to produce up to now, because of the exclusive use of a casting method.

Accordingly, an object of the present invention is a method for the production of a material, whereby an aluminum-based alloy having a content between 5.5 and 13.0 mass-% silicon, additionally a content of magnesium according to the formula $$Mg\ [\text{mass-\%}]=1.73\times Si\ [\text{mass-\%}]+m$$

where m=1.5 to 6.0 mass-% magnesium as well as copper having a content between 1.0 and 4.0 wt.-% (remainder aluminum)—is melted, cast or pre-compacted by means of spray-compacting, and the base alloy is subsequently heat-formed at least once, as well as subsequently subjected to a heat treatment consisting of solution heat treatment, quenching, and artificial aging.

The magnesium is therefore added as a function of the desired silicon content, in each instance, in accordance with the formula stated above. In this connection, part of the magnesium (1.73×Si content) reacts directly with the silicon to form magnesium silicide, the remaining 1.5 to 6.0 mass-% magnesium dissolve in the aluminum mixed crystal and result in an increase in strength of the material, after suitable heat treatment, together with copper. The material can contain the contaminants that are usual in aluminum alloys. In addition, for the purpose of further increasing the strength, it might appear practical to alloy in other alloy elements. For example, the strength-increasing effect of adding small amounts (0.05 to 0.2%), zirconium, or vanadium (FR 2 690 957 A1) is known, also known is the effect of 0.1 to 0.5% silver, which has a positive effect on the heat-resistance properties in the case of AlCu alloys. The addition of small contents (0.2 to 2%) of other alloy elements that find use in many aluminum-copper-magnesium alloys, for example nickel, cobalt, or manganese or iron, also has no disadvantages for the mechanical properties. However, the density of the claimed light-construction material is generally increased by adding the aforementioned materials.

The material that can be obtained according to the method according to the invention is characterized not only by its low density but also by excellent strength properties, which prove to be superior as compared with the piston alloys that are generally in use today, even at elevated temperatures.

Advantageous further developments are evident from the dependent claims.

The base alloy can be treated with all known hot-forming methods, for example extrusion, hot rolling, or forging. Hot forming should be carried out with a degree of deformation greater than five times.

In order not to impair the quality of the material, the aluminum being used, or the base alloy, should contain foreign elements only in a small proportion, specifically not more than 1 mass-% per foreign element, in each instance.

In order to achieve maximal strength properties, it is advantageous to carry out a heat treatment after the hot forming. This can take place in known manner, by means of solution heat treatment, quenching, and artificial aging.

The material according to the invention is suitable for the production of components of all types, particularly of pistons for internal combustion engines.

EXEMPLARY EMBODIMENT 1

An alloy A having the following composition:

8.1 mass-% silicon 17.2 mass-% magnesium 1.7 mass-% copper 0.3 mass-% iron 50 ppm beryllium remainder aluminum is produced, in that the individual elements are alloyed according to the usual methods, and cast to form a cylindrical block, by means of the method of spray-compacting. The resulting preliminary material is preheated to 400 to 500° C. and deformed ten times by means of extrusion, and subsequently hardened. In addition, a heat treatment, comprising solution heat treatment at 500° C. for 2 hours, quenching in water, and annealing for 10 hours at 210° C., is carried out.

Beryllium is added in order to reduce the tendency of the melt to oxidize. Iron was analyzed as a contaminant.

EXEMPLARY EMBODIMENT 2

An alloy B having the following composition:

6.0 mass-% silicon 12.5 mass-% magnesium 2.1 mass-% copper 0.2 mass-% iron 50 ppm beryllium 1.0 wt.-% magnesium phosphate remainder aluminum is produced, in that the individual elements are alloyed according to the usual methods, and cast to form a cylindrical block, by means of continuous casting. The resulting preliminary material is preheated to 400 to 500° C. and deformed ten times by means of extrusion, and subsequently hardened. In addition, a heat treatment, comprising solution heat treatment at 500° C. for 2 hours, quenching in water, and annealing for 10 hours at 210° C., is carried out.

Beryllium is added in order to reduce the tendency of the melt to oxidize; magnesium phosphate serves to increase the grain fineness of the magnesium silicide that solidifies primarily. Iron was analyzed as a contaminant.

EXEMPLARY EMBODIMENT 3

An alloy C having the following composition:

12.9 mass-% silicon 25.1 mass-% magnesium 1.9 mass-% copper 0.15 mass-% iron 50 ppm beryllium 0.9 wt.-% magnesium phosphate remainder aluminum is produced, in that the individual elements are alloyed according to the usual methods, and cast to form a cylindrical block, by means of continuous casting. The resulting preliminary material is preheated to 400 to 500° C. and deformed ten times by means of extrusion, and subsequently hardened. In addition, a heat treatment, comprising solution heat treatment at 500° C. for 2 hours, quenching in water, and annealing for 10 hours at 210° C., is carried out.

Beryllium is added in order to reduce the tendency of the melt to oxidize; magnesium phosphate serves to increase the grain fineness of the magnesium silicide that solidifies primarily. Iron was analyzed as a contaminant.

The finished material demonstrates the following properties:

| | Alloy A | Alloy B | Alloy C | 2618 | AlSi12Cu6MgTiZrV |
|---|---|---|---|---|---|
| Density [g/cm$^3$] | 2.50 | 2.60 | 2.46 | 2.77 | 2.75 |
| Therm. expansion coefficient [1/K] | $23 \times 10^{-6}$ | $23.5 \times 10^{-6}$ | $22.5 \times 10^{-6}$ | $24 \times 10^{-6}$ | ./. |
| Modulus of elasticity [GPa] | 79.3 | 78 | 82 | 72 | ./. |
| Tensile strength [N/mm$^2$] | 390 | 390 | 390 | 420 | 270 |
| Proof stress [N/mm$^2$] | 335 | 335 | 335 | 350 | 235 |
| Elongation at rupture [%] | 2.4 | 1.5 | 1.1 | 7.0 | ./. |
| Fatigue resistance [N/mm$^2$] | | | | | |
| Room temperature | 255 | 255 | 250 | 200 | 131 |
| 200° | 140 | 135 | 135 | 115 | 97 |
| 250° | 100 | 100 | 100 | 95 | 76 |

The material according to the invention is characterized, as compared with the British Aluminium Standard 2618, by a lower density and an increased modulus of elasticity. The static strength properties achieved are equal to the high-strength kneaded alloy 2618. The fatigue resistance that was determined clearly surpasses the values achieved with the kneaded alloy 2618. As compared with the cast alloy from U.S. Pat. No. 6,419,769 A, the material according to the invention is superior both in static and in dynamic tests. Because of this combination of properties, it is particularly suitable for the production of pistons for internal combustion engines.

The invention claimed is:

1. A method for the production of a high-strength material, comprising the steps of:

producing a block of aluminum-based base alloy, the base alloy including a content of 5.5 to 13.0 mass-% silicon, a content of magnesium according to the formula Mg [mass-%]=1.73×Si [mass-%]+m, where m=1.5 to 6.0 mass-% magnesium, and a content of copper between 1.0 and 4.0 mass-%;

hot-forming the base alloy block into a hot-formed element in at least one hot-forming step subsequent to the producing step; and subjecting the hot-formed element to a heat treatment in a heat treatment step after the hot-forming step, the heat-treatment consisting of a solution heat treatment, a quenching, and an artificial aging;

wherein the base alloy contains 0.5 to 1.5 wt.-% magnesium phosphate for the purpose of increasing grain fineness of primary magnesium silicide in the base alloy.

2. The method according to claim 1, wherein the producing step comprises spray compacting.

3. The method according to claim 1, wherein the base producing step comprises continuous casting.

4. The method according to claim 3, wherein the hot forming step comprises a degree of deformation exceeding five.

5. The method according to claim 1, wherein producing step comprises chill casting.

6. The method according to claim 1, wherein the hot-forming step is selected from the group consisting of extrusion, hot rolling, and forging.

7. The method according to claim 1, wherein the content of copper in the base alloy ranges between 1.5 and 3.0 mass-%.

8. The method according to claim 1, wherein the aluminum contains less than 1 mass-% foreign elements.

9. Method according to claim 1, wherein the heat treatment step consists of solutionizing the hot-formed element at 500° C. for 2 h, quenching in water, and subsequently annealing at 210° C. for 10 h.

10. A material on the basis of an aluminum alloy, obtained by the method according to claim 1.

11. The material according to claim 10, wherein the material is shaped as a internal combustion engine component such as a piston.

12. A method for the production of a high-strength material, comprising the steps of:

producing a block of aluminum-based alloy, the alloy including a content of 5.5 to 13.0 mass-% silicon, a content of magnesium according to the formula Mg [mass-%]=1.73×Si [mass-%]+m, where m=1.5 to 3.2 mass-% magnesium, a content of copper between 1.0 and 4.0 mass-% and a content of magnesium phosphate between 0.5 and 1.5 wt.-%;

hot-forming the alloy block subsequent to the spray producing step at least once to obtain a hot-formed element; and subjecting the hot-formed element to a heat treatment after the hot-forming step, the heat-treatment step consisting of a solution heat treatment, a quenching, and an artificial aging.

13. The method according to claim 12, wherein 50 ppm of beryllium are added to the alloy.

14. An aluminum-based alloy, wherein the alloy is selected from the group of alloys L1 to L3, in wt.-% consisting of

| | Si | Mg | Cu | Fe | Magnesium Phosphate |
|---|---|---|---|---|---|
| L1 | 8.1 | 17.2 | 1.7 | 0.3 | |
| L2 | 6.0 | 12.5 | 2.1 | 0.2 | 1.0 |
| L3 | 12.9 | 25.1 | 1.9 | 0.15 | 0.9 |

with the remainder of the alloy consisting of aluminum apart from inevitable impurities and 50 parts per million beryllium.

15. The alloy according to claim 14, wherein the alloy is shaped as an internal combustion engine component.

16. The alloy according to claim 14, wherein the alloy is obtained in an alloy composition step selected from the group consisting of spray compacting and casting, wherein the composed alloy is subsequently subjected to at least one hot-forming step to achieve a hot-formed element presenting a degree of deformation exceeding five, and wherein the hot-formed element is subjected to a heat treatment after the hot-forming step, the heat-treatment step consisting of a solution heat treatment, a quenching, and an artificial aging.

* * * * *